United States Patent [19]

Bruner

[11] 4,095,548

[45] Jun. 20, 1978

[54] DOCKING AND MOORING DEVICE

[76] Inventor: Frank D. Bruner, 10012 Emmet St., Omaha, Nebr. 68134

[21] Appl. No.: 731,184

[22] Filed: Oct. 12, 1976

[51] Int. Cl.[2] ..... B63B 21/04; F16G 11/00

[52] U.S. Cl. ..... 114/230; 114/221 R; 24/115 R; 24/131 R; 211/120

[58] Field of Search ..... 114/218, 221 R, 230; 403/229, 360; 24/261 D, 115 R, 116.1, 131 R; 211/120, 119.1, 119.01

[56] References Cited

U.S. PATENT DOCUMENTS

| | | | |
|---|---|---|---|
| 2,518,401 | 8/1950 | Thompson | 211/69.8 |
| 2,900,689 | 8/1959 | Pearson | 114/218 X |
| 3,473,505 | 10/1969 | Brown | 114/230 |

FOREIGN PATENT DOCUMENTS

| | | | |
|---|---|---|---|
| 41,275 | 6/1915 | Sweden | 114/218 |

*Primary Examiner*—Stanley H. Tollberg
*Assistant Examiner*—Edward M. Wacyra
*Attorney, Agent, or Firm*—Henderson, Strom, Sturm, Cepican & Fix

[57] ABSTRACT

A device for docking and mooring a boat including an elongate member having a series of convolutions formed therein to provide a continuous convoluted surface. When a throwline having an enlarged end portion is engaged with the convoluted surface, contact will be maintained therebetween so long as tension is maintained no matter what directional changes are made between the line and the surface. Several embodiments are disclosed ranging from catching devices alone to such devices which may be released from a remote location.

6 Claims, 9 Drawing Figures

DOCKING AND MOORING DEVICE

BACKGROUND OF THE INVENTION

This invention relates generally to docking and mooring devices, and specifically to such devices which employ a convoluted surface to catch and hold a throw-line having an enlarged end portion.

There are known in the art a number of devices which may generally be described as docking and mooring devices. The most well known of these devices is in the form of a cleat which is affixed to a dock and used to tie off a boat line to thereby secure the vehicle to the dock. A cleat cannot be easily engaged by a throw-line from a boat; however, it is not uncommon to see boat hands trying to lasso a cleat with a looped throw-line. Obviously, this approach to mooring and docking is not only difficult, but also quite dangerous.

Other devices of this nature include mooring buoys such as shown in U.S. Pat. Nos. 3,110,046 and 3,473,505. Both of the buoys described in these patents are circular with periferal fingers into which a line having an enlarged end is thrown for engagement. Besides substantially limited use for mooring of water vehicles, very small targets are provided for the throw-line, consequently requiring extremely close approachment for engagement. Additionally, these buoys do not provide a completely secure attachment, i.e., in rough or even moderate waves, the attachment may become undone.

SUMMARY OF THE INVENTION

It is therefore an object of this invention to provide a docking and mooring device which is durable of construction, inexpensive of manufacture and extremely effective in use.

It is another object of this invention to provide a docking and mooring device which, once engaged by a throw-line with an enlarged end portion will maintain that engagement so long as tension is maintained no matter what changes are made between the relative positioning of the line and the device.

Another object of this invention is to provide a docking and mooring device which requires a minimum of skill to operate, thus permitting substantially anyone to properly dock and moor a boat; even in heavy wind and/or current conditions.

Another object of this invention is to provide a docking and mooring device which, with a slight flick of the wrist securely affixes the throw-line to the device or releases the throw-line from the device.

A further object of this invention is to provide a docking and mooring device which has means thereon to selectively guide a throwline into engagement with a catching means or release said throw-line from said catching means.

It is a still further object of this invention to provide a docking and mooring device which is suitable for use with both large and small water craft in all kinds of weather and water conditions.

These and other objects are accomplished according to the instant invention by providing a device for docking and mooring a boat including an elongate member having a series of convolusions formed therein to provide a continuous convoluted surface. When a throw-line having an enlarged end portion is engaged with the convoluted surface, contact will be maintained therebetween so long as tension is maintained no matter what directional changes are made between the line and the surface. Several embodiments are disclosed ranging from catching devices alone to such devices which may be released from a remote location.

BRIEF DESCRIPTION OF THE DRAWINGS

The above and other objects will be readily apparent upon a reading of the following detailed description, especially when taken in conjunction with the accompanying drawings wherein.

DESCRIPTION OF THE PREFERRED EMBODIMENTS

Figure 1:
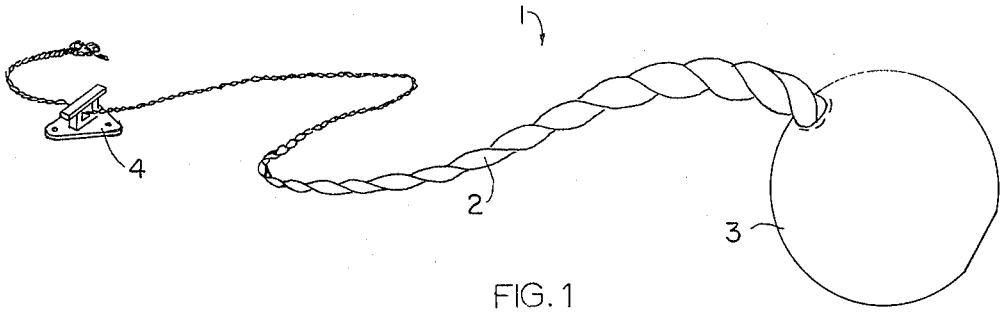
FIG. 1 is a schematic view of a throw-line suitable for use with the instant invention.

Referring now to FIG. 1, a throw-line 1 suitable for use with the instant invention is schematically represented. The throw-line is a very simple structure and comprises an elongated rope member 2 having an enlarged end portion thereon 3. End portion 3 may be in the form of a knot or an attached member such as a plastic or metal sphere. Also shown in this Figure is a cleat 4 which ordinarily would be affixed to some portion of the boat.

Figure 2:
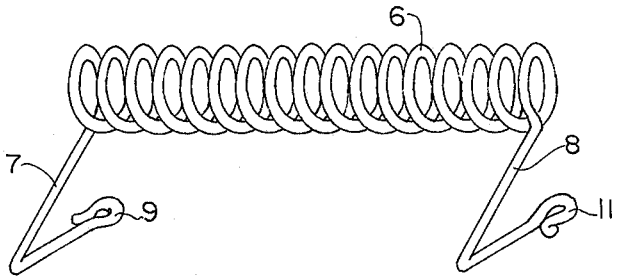
FIG. 2 is a partially schematic, perspective view of one embodiment of the docking and mooring device of the instant invention.

FIG. 2 shows a catching device according to the instant invention comprised of a series 6 of regularly spaced convolutions formed in an elongated rod-type member. Ends 7 and 8 of the elongated member have been bent to form hooks 9 and 11 on the end thereof through which bolts or screws are positioned to affix the device to a dock or other support structure. The convoluted surface is shown in the form of a coil; however, other substantially continuous surfaces may be formed that will provide suitable structure necessary to accomplish the invention. It should be noted that the invention functions quite suitably with a regularly spaced coil pattern, but irregular spacings could be employed if desired. Also, it should be noted that size is of little importance, but that a coil diameter of approximately three inches has been found to be quite satisfactory.

With the device of FIG. 2 positioned on a dock, a boat approaches and the throwline 1 is thrown over the coil section 6 and pulled taut. This, in turn, pulls the enlarged end portion 3 into contact with the convoluted surface of the coil. Contact will be maintained so long as tension is kept on the line. Because of the continuous nature of the surface of the coils, the enlarged portion 3 will stay in contact therewith even if the throw-line is moved 360° around the coil at an oblique angle to the axis of the coil. This is because the enlarged portion 3 will ride around the coil substantially opposite the line 2.

Figure 3:
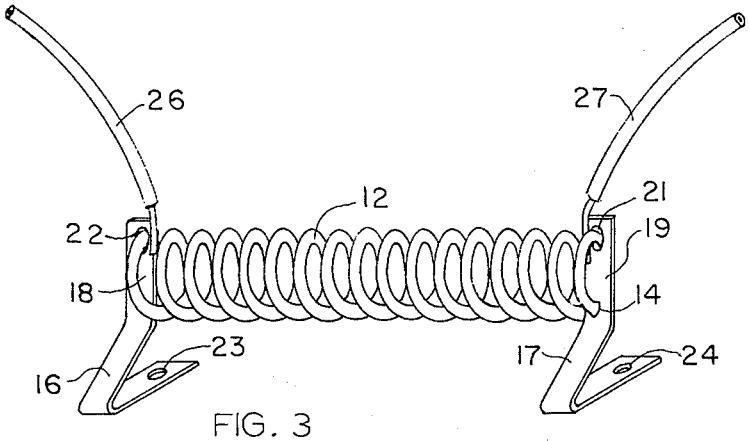
FIG. 3 is a partially schematic perspective view of another embodiment of the docking and mooring device of the instant invention.
Figure 4:
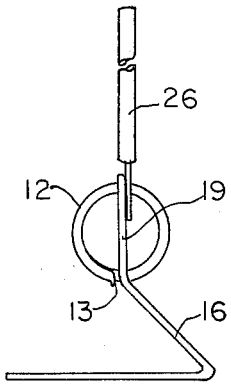
FIG. 4 is an end view of the device of FIG. 3.

FIG. 3 shows a slightly modified version of the catching device depicted in FIG. 2. Coil 12 has end portions 13 and 14, see FIG. 4 also, which have been inserted through holes 21 and 22 in support legs 16 and 17. Support structures 16 and 17 have been formed with a horizontal portion with holes 23 and 24 therein and vertical sections 18 and 19. When the ends 13 and 14 of the coil are inserted through holes 21 and 22 they abut against the vertical portions 18 and 19 to form a stable structure. Additionally, guide members 26 and 27 have been affixed to the support arms to provide an aid in directing the throw-line 1 into the coils. Additionally, the construction of the support legs 16 and 17 is such that they will have a spring action when tension is applied to the throw-line to absorb the movements of the boat with the wave action. Obviously, the spring action additionally gives more mooring strength to the device than would otherwise be present.

Figure 5:
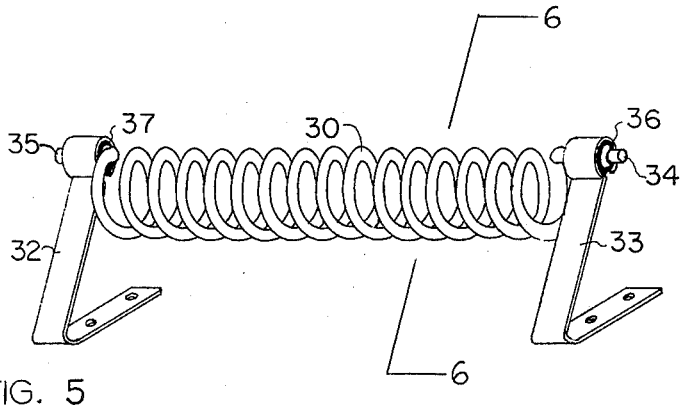
FIG. 5 is a partially schematic perspective view of still another embodiment of the instant invention.
Figure 6:
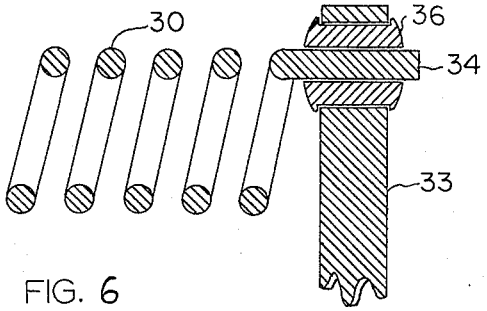
FIG. 6 is a partially schematic, sectional view of the device of FIG. 5 taken along line 6—6.

Referring now to FIGS. 5 and 6, a still further embodiment of the docking and mooring device of the instant invention can be seen. A coil 30 is movably affixed to leg support members 32 and 33 by the insertion of coil ends 34 and 35 into bearings 36 and 37 which are affixed to the leg support members. Thus, the coil 30 is free to rotate about the longitudinal axis formed by coil end portions 34 and 35. As will become apparent, this free rotation characteristics adds considerably to the flexibility of the device. Specifically, when the throw-line 1 is passed through coil 30 and pulled taut against the coil, the previously explained continuous contact feature is exhibited. However, if after the initial engagement, the deck hand flips the line 2 in a vertical direction the coil will rotate about its axis and the line will engage, or pass through, a full convolution of the coil and become fixed therein. The line may be flipped in the same direction any number of times to increase the securement. Then, when it is desired to release the engagement, the line is flipped vertically in the opposite direction to reverse rotate the coil and eventually disengage the enlarged end portion 3. This locking feature is very advantageous, especially in a mooring device which is fixed in open water for instance.

Figure 7:
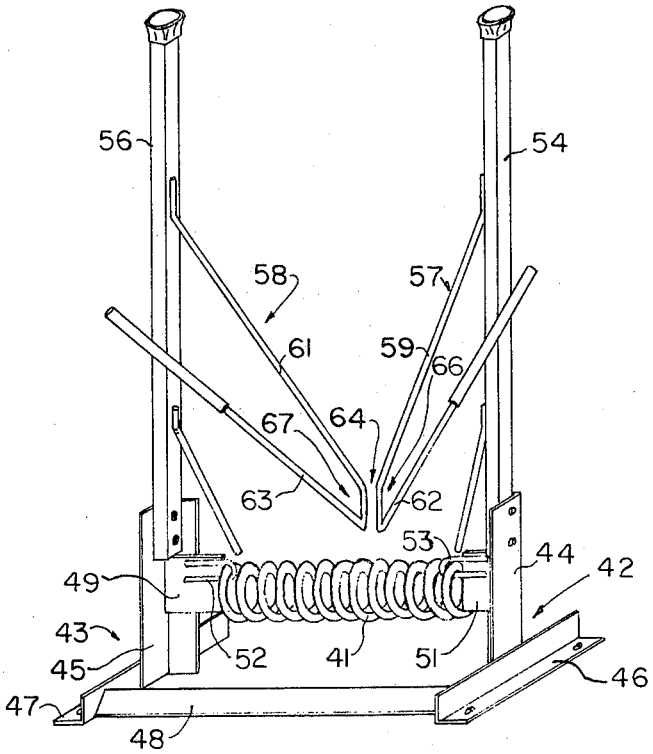
FIG. 7 is a schematic view of a still further embodiment of the instant invention.
Figure 8:
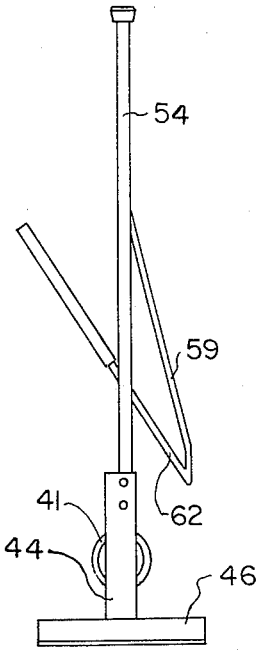
FIG. 8 is an end view of the device of FIG. 7.
Figure 9:
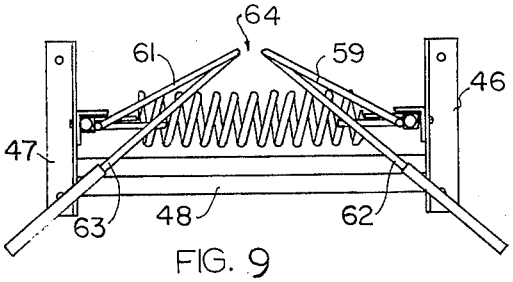
FIG. 9 is a top plan view of the device of FIGS. 7 and 8.

Attention is now directed to FIGS. 7 through 9 wherein another self-releasing embodiment is shown. The device set forth in these figures comprises a horizontal coil 41 held in position by end supports 42 and 43. The end supports comprise vertical members 44 and 45, horizontal stabilizer members 46 and 47, and cross member 48 affixed at its ends to the horizontal stabilizer members. The ends of the coil 41 are fixed in position relative to plates 49 and 51, which are attached to vertical members 44 and 45, by U-shaped brackets 52 and 53. Obviously, the coil support structure can be in innumerable forms that described immediately above being only one example.

Upright members 54 and 56 extend upwardly from end supports 42 and 43, respectively, and hold guide and release arms 57 and 58 in proper position relative to each other and to coil 41. The guide and release arms are bent to form guide sections 59 and 61, and release sections 62 and 63. The guide sections extend convergingly away from the upright members to spaced positions above and to one side of the coil 41. The gap 64 between the spaced positions is at least large enough to allow passage of the line 2, but is generally much larger, on the order of 3 or 4 inches. The release sections 62 and 63 extend upwardly and forwardly in diverging directions away from the spaced positions. The release sections are spaced from upright members to allow the line 2 to pass therebetween, as will be described further below. The bends 66 and 67 in the arms 57 and 58 are gradual to prevent the line 2 and enlarged end 3 from becoming locked therein.

In operation, the enlarged end of the throw-line is thrown between upright members 54 and 56, and the line is directed to coil. 41 through gap 64 by guide sections 59 and 61. By pulling the line taut, the enlarged end portion is engaged with the convoluted surface of the coil 41, and the water vehicle pulled into docking position. When it is desired to leave the dock, the line 2 is flipped over one of the release sections 62 or 63, and the line is pulled. This causes the line to ride down the release section into, or near the bend. Since the bend is behind the coil 41, the enlarged end portion is pulled backwards out of engagement with the coil. The line and enlarged end portion then slide through the bend and over the release arm.

It will be understood that various changes in the details, materials, steps and arrangements of parts, which have herein been described and illustrated in order to explain the nature of the invention, will occur to and may be made by those skilled in the art upon a reading of the disclosure within the principles and scope of the invention.

For example, the constructional technique employed in the devices shown is welding, but certainly nuts and bolts, or any other suitable methods may be used.

Also, various safety features may be incorporated to improve commercial acceptability. To this end, the ends of the various arms and guides may be covered with plastic or rubber protectors.

It should further be understood that, in a simpler form, the catching means of the instant invention may comprise, for example, a coil which is supported by its ends with ropes or other means between two upright members. Obviously, this arrangement would be set up at a docking area, and the support lines would serve double duty as guides for the throw-line.

I claim:

1. A docking and mooring device for use with a throwline having an enlarged end portion, said device comprising:

a semi-rigid catching means adapted to be affixed to a support, said catching means including an elongate horizontally disposed coil member having a first end and second end, said elongate member having a series of convolutions spaced apart, said elongate member being devoid of interior structure to permit the throwline to engage the coil member by falling freely between adjacent convolutions, said convolutions providing a continuous convoluted surface that once engaged by the throwline the enlarged end portion will continuously engage said surface as long as tension is maintained on the throwline, no matter what directional changes are made to the throwline relative to said surface.

2. The device of claim 1 wherein said coil has a front longitudinal side, an opposing rear side and a top side therebetween, said device further including:

bracket means affixed to said first and second ends of said coil; and first and second substantially symetrical elongate arm members affixed to said bracket means, said arm members including first sections extending diversely away from spaced points above the top side of the coil and behind the rear side thereof opposite the front side to a higher planar location in front of the front side of the coil opposite the rear side thereof.

3. The device of claim 2 wherein said arm members further include second sections extending diversely away from said spaced points toward the front side of said coil.

4. The device of claim 3 wherein said bracket means includes upstanding braces on the ends of said coil, said elongate arm members being affixed, respectively, to said braces.

5. The device of claim 4 wherein said bracket means further includes horizontal braces affixed to said upstanding braces adapted to be affixed to a support.

6. The device of claim 5 wherein said coil is comprised of round bar stock.

* * * * *